United States Patent [19]

Noguchi et al.

[11] Patent Number: 4,491,096

[45] Date of Patent: Jan. 1, 1985

[54] TWO-STROKE CYCLE ENGINE

[75] Inventors: Masaaki Noguchi, Nagoya; Yukiyasu Tanaka; Isao Igarashi, both of Okazaki, all of Japan

[73] Assignee: Toyota Jidosha Kogyo Kabushiki Kaisha, Japan

[21] Appl. No.: 17,968

[22] Filed: Mar. 6, 1979

[30] Foreign Application Priority Data

Aug. 16, 1978 [JP] Japan ..... 53-99667

[51] Int. Cl.[3] ..... F02B 25/08

[52] U.S. Cl. ..... 123/51 B; 123/70 R

[58] Field of Search ..... 123/51 R, 51 B, 51 BA, 123/51 BD, 56 R, 56 B, 56 BC, 65 R, 65 A, 70 R, 70 V, 73 R, 73 A, 73 AF

[56] References Cited

U.S. PATENT DOCUMENTS

| | | | |
|---|---|---|---|
| 1,077,956 | 11/1913 | Fox | 123/70 R |
| 2,281,821 | 5/1942 | Balmer | 123/70 R |
| 2,347,444 | 4/1944 | Vincent | 123/70 R |
| 4,071,000 | 1/1978 | Herbert | 123/51 BD |
| 4,185,596 | 1/1980 | Noguchi et al. | 123/70 R |

FOREIGN PATENT DOCUMENTS

| | | | |
|---|---|---|---|
| 1526444 | 2/1970 | Fed. Rep. of Germany | 123/65 R |

*Primary Examiner*—Craig R. Feinberg
*Assistant Examiner*—W. R. Wolfe
*Attorney, Agent, or Firm*—Finnegan, Henderson, Farabow, Garrett & Dunner

[57] ABSTRACT

A two-stroke cycle gasoline or diesel engine having: at least two two-stroke cycle power cylinder - piston assemblies each having two horizontally opposed pistons, incorporating uniflow scavenging, and operating with a phase difference of 180° relative to each other; at least one double acting scavenging pump cylinder - piston assembly which has two horizontally opposed pistons and is driven by the power cylinder - piston assemblies by way of a pair of mutually synchronized common crankshafts and crank mechanisms which connect the pistons of the power cylinder - piston assemblies and the pump cylinder - piston assembly with the common crankshafts, wherein the crank radius of the common crankshafts with respect to the pump cylinder - piston assembly is substantially smaller than that with respect to the power cylinder - piston assemblies.

4 Claims, 8 Drawing Figures

TWO-STROKE CYCLE ENGINE

BACKGROUND OF THE INVENTION

The present invention relates to a two-stroke cycle engine, and, more particularly, to a two-stroke cycle engine adapted for use with automobiles.

A two-stroke cycle engine has theoretically the advantage that an engine of a certain size can generate a greater power than a four-stroke cycle engine of a bigger size because the two-stroke cycle engine has twice as many work cycles per revolution as the four-stroke cycle engine. In fact, however, the conventional two-stroke cycle gasoline engine employing a carburetor has such drawbacks as that it has high fuel consumption as compared with the four-stroke cycle engine due to the loss of air-fuel mixture caused by the direct escape, i.e. blow-out, of scavenging mixture to the exhaust manifold during scavenging, and that it cannot generate such a high power as expected from the fact that is has twice as many work strokes as the corresponding four-stroke cycle engine, due to the fact that the scavenging is still insufficient. Because of these problems, the practical use of two-stroke cycle gasoline engines is presently limited to the field of small engines, which must be simple in structure and low in manufacturing cost.

Conventional two-stroke cycle gasoline engines of the abovementioned type, therefore, generally employ crankcase compression for scavenging. However, the scavenging by crankcase compression is not fully effective, and can only provide a relatively low volumetric efficiency. This is the principal cause of the poor output power of conventional two-stroke cycle gasoline engines. In fact, a volumetric efficiency as high as 80% is available in four-stroke cycle engines, while, on the other hand, the volumetric efficiency of typical two-stroke cycle engines is still as low as 40–50%. The pump stroke volume of crankcase compression is equal to the stroke volume of the engine. However, since the crankcase has a relatively large clearance volume, the compression ratio of crankcase compression is relatively low, so that as a result the amount of air-fuel mixture drawn into the crankcase is small, the amount of delivered mixture is small, the delivery pressure is low and hence the scavenging pressure is low, and consequently it is hard to supply a really adequate amount of scavenging mixture into the power cylinder. As a result, the delivery ratio obtained in an engine wherein scavenging is effected only by the normal crankcase compression is only as high as 0.5–0.8. Furthermore, since the trapping efficiency is about 0.7, the volumetric efficiency becomes as low as 40–50% as mentioned above.

The purpose of scavenging is to push the residual exhaust gases in the power cylinder out of it by fresh mixture, and, the therefore, if the pressure of the residual exhaust gases and the distance between the scavenging port and the exhaust port are given, the time required for completing scavenging is determined by the pressure and the amount of scavenging mixture, provided that stratified scavenging is performed. Now, if the scavenging pressure is low, as when crankcase compression is used, a relatively long time is required for completing scavenging, particularly when the scavenging is performed by uniflow scavenging. Therefore, when the engine is rotating at high speed, it may well occur that the exhaust port is closed before the scavenging is completed, so that a large amount of exhaust gas still remains in the power cylinder, and only a very small amount of fresh mixture is charged into the power cylinder. Therefore, conventional two-stroke cycle engines have been unable to operate satisfactorily in the high speed range.

In view of these problems, the idea of providing a special scavenging pump in addition to crankcases which are adapted to perform crankcase compression so as to increase the amount and the pressure of scavenging mixture so far that the volumetric efficiency be increased up to 75–90%, or in some cases even up to 100% has been proposed. This increases the output power of a two-stroke cycle gasoline engine per unit volume of its power cylinder, Lowering the rotational speed of such an engine depending upon the increase of output power per unit volume of the power cylinder permits scavenging with the increased amount and pressure of scavenging mixture without causing any substantial mixing between scavenging mixture and exhaust gases, and reduces power loss due to internal friction in the engine. Thus the output power per unit volume of the power cylinder or of the engine itself is even more increased. Further, reducing the volume, in particular the height of the engine, depending upon the aforesaid increased output power per unit volume of the engine, also reduces the height of the engine compartment, so that the air resistance of the vehicle is reduced, with corresponding improvement of the fuel consumption. We have proposed, in a co-pending U.S. patent application Ser. No. 917,244 now U.S. Pat. No. 4,287,859, a two-stroke cycle gasoline engine comprising at least one two-stroke cycle power cylinder - piston assembly incorporating uniflow scavenging and two horizontally opposed pistons, and a scavenging pump means including at least one pump cylinder - piston assembly of the reciprocating type driven by said power cylinder - piston assembly in synchronization therewith, wherein the total stroke volume of said scavenging pump means is between 1.35 and 1.85 times as large as that of said power cylinder - piston assembly, and the operational phase of a pump cylinder - piston assembly is so shifted relative to that of the power cylinder - piston assembly to which it supplies scavenging mixture that, when the power cylinder - piston assembly is at its bottom dead center, the pump cylinder - piston assembly is at or slightly before its top dead center.

In the abovementioned patent application, we have proposed, as an embodiment of the two-stroke cycle gasoline engine having the aforementioned basic structure, an engine which has two power cylinder - piston assemblies of the aforementioned type adapted to operate with a phase difference of 180° therebetween and one double-acting reciprocating type pump cylinder - piston assembly incorporating two horizontally opposed pistons as the aforementioned pump cylinder - piston assembly, which is more compact as a whole and is able to generate large output power. This formerly proposed two-stroke cycle gasoline engine having a double-acting pump cylinder - piston assembly incorporating two horizontally opposed pistons includes a pair of common crankshafts adapted to rotate in synchronization with each other, wherein two two-stroke cycle power cylinder - piston assemblies each incorporating two horizontally opposed pistons have individually a pair of crank mechanisms including a pair of connecting rods connected to said pair of common crankshafts. On the other hand the double-acting pump cylinder - piston assembly has a pair of driving mechanisms including a pair of O-members engaged with the crank pins of said pair of common crankshafts, so that the two two-stroke cycle power cylinder - piston assemblies and the double-acting pump cylinder - piston assembly are operated in synchronization with each other. In this formerly proposed engine, the crank radius of each of the said pair of common crankshafts with respect to the power cylinder - piston assemblies was substantially the same as that with respect to the pump cylinder - piston assembly, so that the strokes of the power pistons of the power cylinder - piston assemblies were substantially the same as the strokes of the pump pistons of the pump cylinder - piston assembly.

However, up to the present date, the most desirable mechanism which can change high speed rotary motion, as in engines, to corresponding high speed reciprocating motion most definitely, without any substantial play, vibration, or failure, is a crank mechanism composed of a crankshaft and a connecting rod. Therefore, in the aforementioned formerly proposed two-stroke cycle gasoline engine having a double-acting pump cylinder - piston assembly incorporating two horizontally opposed pistons, it is, of course, desirable that the pump pistons should be connected with said pair of crankshafts by a pair of crank mechanisms each including a connecting rod, if possible. However, in the case of a double-acting pump cylinder - piston assembly in which the smaller end portion of a connecting rod, i.e. the end of a connecting rod opposite to its larger end where the connecting rod engages with a crank pin, cannot be directly connected with a pump piston, but must be connected with the outer end of a push rod which extends through an end plate and is connected with a pump piston at its inner end, since a connecting rod is exerted with a side force which acts in a direction perpendicular to the direction of reciprocation of a piston, a cross head is required at the connecting portion of the push rod and the connecting rod so as to support the side force. However, since the aforementioned two-stroke cycle gasoline engine is particularly intended for use as an engine for a small-size automobile, it is severely limited with regard to its width due to the limited space available in the engine compartment of a small-size automobile, and therefore in the structure of the aforementioned formerly proposed engine, wherein the pump piston of the pump cylinder - piston assembly has substantially the same piston stroke as the power piston of the power cylinder - piston assembly, it is absolutely impossible to obtain enough space for providing the aforementioned cross head. The same problem is recognized with respect to the two-stroke cycle diesel engine which we have proposed in co-pending U.S. patent application Ser. No. 966,597 now U.S. Pat. No. 4,248,183.

SUMMARY OF THE INVENTION

Therefore, it is the object of the present invention to solve this problem, and to provide a further improved two-stroke cycle gasoline or diesel engine of the aforementioned kind.

In accordance with the present invention, the abovementioned object is accomplished by providing a two-stroke cycle engine comprising: at least two two-stroke cycle power cylinder - piston assemblies each having two horizontally opposed pistons and two crankcases, incorporating uniflow scavenging, and operating with a phase difference of 180° relative to each other; at least one double-acting pump cylinder - piston assembly which has two horizontally opposed pistons and is driven by said power cylinder - piston assemblies so as to supply two separate charges of scavenging fuel-air mixture or air to said two power cylinder - piston assemblies with a phase difference of 180° therebetween; and a pair of common crankshafts adapted to rotate in synchronization with each other, each of said power cylinder - piston assemblies and said pump cylinder - piston assembly having a pair of crank mechanisms which incorporate said pair of common crankshafts so as to operate in synchronization with each other, wherein the crank radius of each said pair of common crankshafts with respect to said pump cylinder - piston assembly is substantially smaller than that with respect to said power cylinder - piston assemblies.

The abovementioned constitution that, in a combination of at least two two-stroke cycle power cylinder - piston assemblies and a double-acting pump cylinder - piston assembly operationally connected by a pair of common crankshafts, the crank radius of each of said pair of common crankshafts with respect to said pump cylinder - piston assembly is substantially smaller than that with respect to said power cylinder - piston assemblies, means that the stroke of the pump piston is substantially smaller than that of the power piston so as to be able to accommodate a cross head between the common crankshaft and the pump piston. In this case, if the degree of reduction of the crank radius with respect to the pump cylinder - piston assembly relative to that with respect to the power cylinder - piston assembly is too small, the stroke of the pump piston will be still relatively large, and since the stroke of the cross head is equal to the stroke of the pump piston, it will be still difficult to accommodate such a cross head. Further, since the oscillating angle of a connecting rod is larger as the crank radius is larger, the side force applied to the connecting rod will be still too large to guarantee smooth sliding movement of the cross head. On the other hand, if the degree of reduction of the crank radius with respect to the pump cylinder - piston assembly relative to that with respect to the power cylinder - piston assembly is too large, although the stroke of the pump piston, and the stroke of the cross head, will become small enough to make it easy to accomodate the cross head between the crankshaft and the pump piston, and at the same time the oscillating angle of the connecting rod will become small enough to reduce the side force applied to the cross head so far as to guarantee smooth sliding movement of the cross head, in this case, however, in order to ensure a predetermined total stroke volume of the pump cylinder - piston assembly, the diameter of the pump cylinder must be substantially increased in order to compensate for the substantial reduction of the stroke of the pump piston, thereby causing the problem that harmony between the diameters of the power cylinder - piston assembly and of the pump cylinder - piston assembly arranged side by side is substantially damaged. Therefore, the degree of reduction of the crank radius with respect to the pump cylinder - piston assembly relative to that with respect to the power cylinder - piston assembly must be determined at an intermediate moderate value positioned between the aforementioned extreme conditions so that neither of the drawbacks becomes notable. In this connection, we note that, under the condition that pump delivery be maintained at a constant value, if the stroke of the pump piston is reduced to be 1/A times as large (A is larger than 1), the diameter of the pump cylinder is to be increased to be only the square root of A times as large, and that, therefore, a relatively large reduction in the stroke of the pump piston does not cause any linearly corresponding increase in the diameter of the pump cylinder. For example, if A is 2, the square root of A is approximately 1.4, and therefore if the stroke of the pump piston is reduced by a half, the diameter of the pump cylinder needs to be increased by only about 40%. In the aforementioned co-pending patent application Ser. No. 917,244 now U.S. Pat. No. 4,287,859, it has been proposed that the total stroke volume of the scavenging pump means should be 1.35–1.85 times as large as that of the power cylinder - piston assembly. The same condition is adopted by the two-stroke cycle engine of the present invention, if it is embodied as a gasoline engine, due to the same reasons as described in the latter co-pending application. Further, if the two-stroke cycle engine of the present invention is embodied as a gasoline engine which incorporates crankcase compression, the total stroke volume of the pump cylinder - piston assembly separate from the power cylinder - piston assemblies needs to be only 0.35–0.85 times as large as the total stroke volume of the power cylinder - piston assemblies. Therefore, when this condition is incorporated, even when the crank radius with respect to the pump cylinder - piston assembly is reduced to be half as large as that with respect to the power cylinder - piston assembly, the diameter of the pump cylinder is, at the most, 1.3 (which equals the square root of 0.85 times the square root of 2) times as large as that of the power cylinder - piston assembly. The same condition is also applicable to the two-stroke cycle gasoline engine which we have proposed in co-pending U.S. patent application Ser. No. 960,657 now abandoned.

Further, when the present invention is applied to the two-stroke cycle diesel engine proposed in the aforementioned co-pending U.S. patent application Ser. No. 966,597 now U.S. Pat. No. 4,248,183, since the total stroke volume of the pump cylinder - piston assembly is 0.5–1.2 times as large as that of the power cylinder - piston assemblies, if the crank radius with respect to the pump cylinder - piston assembly is reduced to be half as large as that with respect to the power cylinder - piston assemblies, the diameter of the pump cylinder should be, at the most, 1.55 (which is the square root of 1.2 times the square root of 2) times as large as that of the power cylinder. These ratios between the diameters of the pump cylinder and the power cylinder are considered to be satisfied while maintaining desirable dimensional harmony between at least two two-stroke cycle power cylinder - piston assemblies and at least one double-acting pump cylinder - piston assembly, each being arranged in parallel with the other in accordance with the basic structure of the engine in which the present invention is incorporated.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
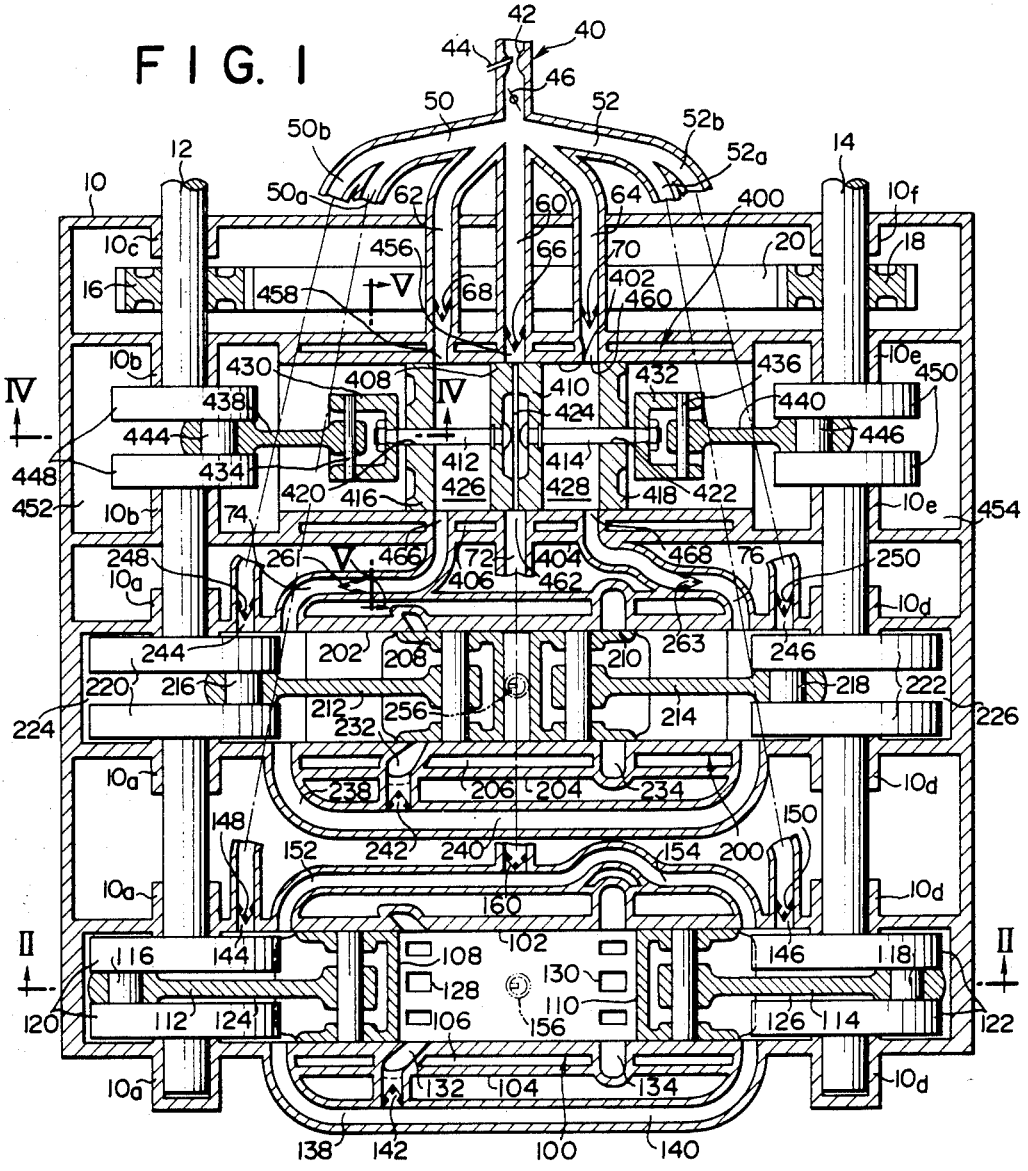
FIG. 1 is a diagrammatical plan sectional view showing an embodiment of a two-stroke cycle gasoline engine in which the present invention is incorporated.

Referring to FIGS. 1–5, the two-stroke cycle gasoline engine herein shown comprises a cylinder block 10, the overall shape of which is like a relatively flat block, rectangular in a plan view, and adapted to be installed with its two largest faces arranged horizontally. In the cylinder block there are provided a pair of crankshafts 12 and 14 which are arranged along the opposite edges of the cylinder block and are rotatably supported by bearings **10*a*–10*c* and 10*d*–10*f*, respectively. In this embodiment, for example, the crankshaft 12 may be connected to auxiliaries of the engine, while on the other hand the crankshaft 14 may serve as the power output shaft of the engine. In the cylinder block 10 there are incorporated first and second two-stroke cycle power cylinder - piston assemblies 100 and 200 each having two horizontally opposed pistons and two crankcases, incorporating uniflow scavenging, and operating with a phase difference of 180° relative to each other, and a double-acting pump cylinder - piston assembly 400 which has two horizontally opposed pistons. Since the two power cylinder - piston assemblies have the same structure, for the purpose of simplicity, only the power cylinder - piston assembly 100 will be described hereinunder. In the drawing, the portions of the power cylinder - piston assembly 200 corresponding to those of the power cylinder - piston assembly 100 are designated by reference numerals which are the reference numerals attached to the corresponding portions of the power cylinder - piston assembly 100**, each increased by 100.

The power cylinder - piston assembly 100 includes a power cylinder 102 supported by the cylinder block 10. The power cylinder is surrounded by a cooling jacket 106 defined by a jacket wall 104. In the cylinder 102 are arranged two power pistons 108 and 110, one being located on the scavenging side or the left side in the figure, while the other is located on the exhaust side or the right side in the figure. The pistons 108 and 110 are individually connected with connecting rods 112 and 114, which in turn are individually connected with crankpins 116 and 118, respectively. The crankpins 116 and 118 are individually supported by crank arms 120 and 122, each of which has a disk shape. The two crank mechanisms each including the disk-shaped crank arms and the crank pin are individually housed in crankcases 124 and 126 having a corresponding internal shape so that, regardless of rotational angle of the crank, the principal internal space of each crankcase is occupied by the crank means, so as to reduce the clearance volume of the crankcase to the minimum value.

Figure 3:
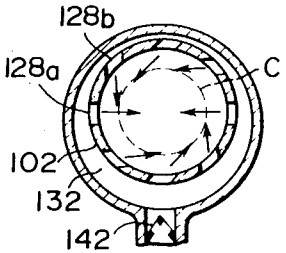
FIG. 3 is a sectional view along line III—III in FIG. 2.
Figure 5:
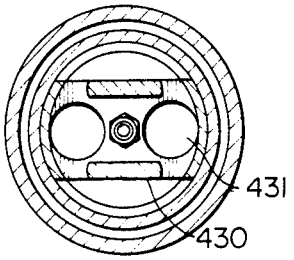
Figure 6:
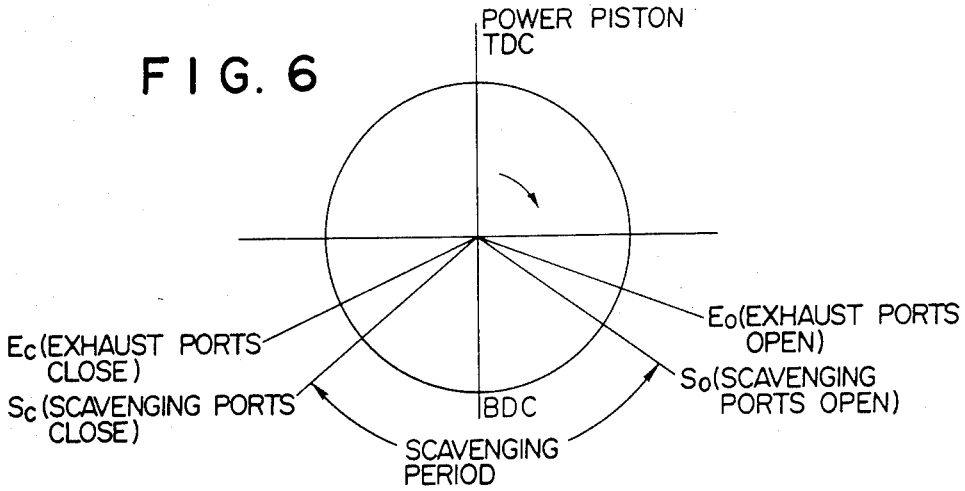
FIG. 6 is a crank angle diagram showing opening and closing phases of the scavenging and exhaust ports in the engine shown in FIG. 5.

The cylinder 102 has a plurality of scavenging ports 128 in its scavenging side and a plurality of exhaust ports 130 in its exhaust side. These scavenging ports are connected with a scavenging plenum 132, and the exhaust ports are connected with an exhaust plenum 134. The exhaust plenum 134 is connected with exhaust pipes 136. As shown in FIG. 3, the scavenging ports 128 include a pair of scavenging ports 128*a* which open towards the central axis of the power cylinder 102, and also six scavenging ports 128*b* which open along axes tangential to a phantom cylinder C coaxial with the cylinder 102. Furthermore, the scavenging ports 128*a* and 128*b* are inclined towards the exhaust side of the cylinder so that the flows of scavenging mixture discharged from these scavenging ports have a velocity component towards the exhaust ports 130. The phases of opening and closing of the scavenging ports 128 and the exhaust ports 130 are determined as shown in FIG. 6. Thus the scavenging mixture discharged from these scavenging ports 128*a* and 128*b* flows through the cylinder 102 towards the exhaust side as a spiral flow. The scavenging plenum 132 is connected with the crankcases 124 and 126 by way of passages 138 and 140, respectively. In the joining portion of the scavenging plenum 132 and the passages 138 and 140 is provided a reed valve 142 which allows fluid to flow only from the passages towards the scavenging plenum, so that blow-back of combustion gases from the power cylinder is prevented. The reed valve may be omitted if there is no danger of causing such blow-back.

An ignition plug 156 is provided at a longitudinally central portion of the power cylinder 102.

Figure 4:
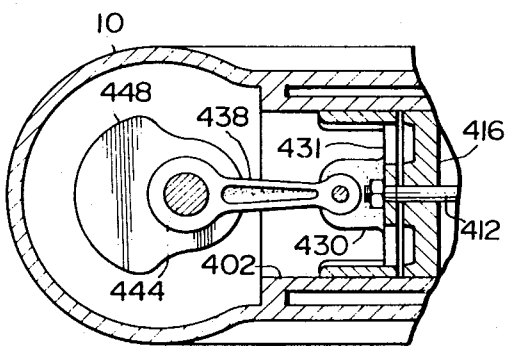
FIGS. 4 and 5 are sectional views along lines IV—IV and V—V in FIG. 1, respectively.

Next, the pump cylinder - piston assembly 400 will be described. This assembly includes a pump cylinder 402 supported by the cylinder block 10. The pump cylinder is surrounded by a cooling jacket 406 defined by a jacket wall 404. In the pump cylinder 402 are opposedly provided a pair of disk-like pump pistons 408 and 410 which are individually connected with push rods 412 and 414 which individually extend through openings 420 and 422 formed in end plates 416 and 418 which close opposite ends of the pump cylinder 402. The openings 420 and 422 are individually constructed as bearing openings which slidably and sealingly receive the push rods 412 and 414, respectively. By this arrangement the inside of the pump cylinder 402 is divided into three pump chambers 424, 426, and 428. The other ends of the push rods 412 and 422 are individually connected with cross heads 430 and 432. The cross head 430 and related structures are also shown in FIG. 4. The cross heads 430 and 432 are individually received in opposed end portions of the pump cylinder 402 so as to be slidable along the central axis of the pump cylinder, and are individually connected with smaller end portions of connecting rods 438 and 440, by way of pins 434 and 436. Larger end portions of the connecting rods 438 and 440 are individually connected with crank pins 444 and 446 which are individually supported by a pair of crank arms 448 and 450 individually incorporated in the crankshafts 12 and 14. The crankcases 452 and 454 which individually house these crank mechanisms are connected with an air cleaner, which is not shown in the figure, by way of positive crankcase ventilation valves, which are not shown in the figure either, so as to balance the pressures in the crankcases. As better shown in FIG. 5, the cross head 430 is formed with openings 431 for the purpose of reducing air resistance during reciprocating movement. Similar openings are also formed in the cross head 432.

40 designates a carburetor which includes a venturi portion 42, a main fuel nozzle 44 which opens to the throat portion of the venturi portion, and a throttle valve 46, and takes in air from its air inlet port located upward in the figure and produces fuel-air mixture in the usual manner. The mixture outlet port of the carburetor 40 is connected with a passage 50, which is branched to two passages 50*a* and 50*b*, which are individually connected with ports 144 and 244, which individually open to the left-hand crankcases 124 and 224 of the first and second power cylinder - piston assemblies 100 and 200, and this mixture outlet port of the carburetor 40 is also connected with a passage 52, which is branched to two passages 52*a* and 52*b*, which are individually connected with ports 146 and 246, which individually open to the right-hand crankcases 126 and 226 of the first and second power cylinder - piston assemblies 100 and 200. In the ports 144, 146, 244, and 246 are individually provided reed valves 148, 150, 248, and 250. The carburetor 40 is further connected with passages 60, 62, and 64, which are individually connected with ports 456, 458, and 460, which individually open to the pump chambers 424, 426, and 428 of the pump cylinder - piston assembly 400. In the passages 60, 62, and 64, in the vicinity of the ports 456, 458, and 460, are individually provided reed valves 66, 68, and 70. The pump chamber 424 is connected with the crankcases 124 and 126 of the power cylinder - piston assembly 100 by way of an outlet port 462, a passage 72, and two passages 152 and 154 branched from the passage 72, respectively. A reed valve 160 is provided at a middle portion of the passage 72. The pump chambers 426 and 428 are connected with crankcases 224 and 226 of the power cylinder - piston assembly 200 by way of outlet ports 466 and 468, and passages 74 and 76, respectively. In the passages 74 and 76 are individually provided reed valves 261 and 263.

Figure 2:
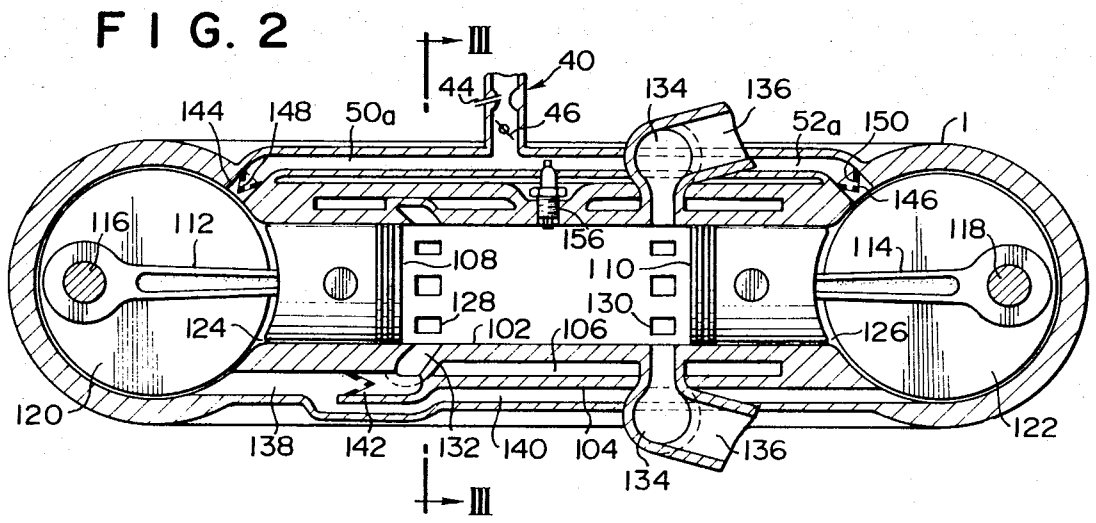
FIG. 2 is a sectional view along line II—II in FIG. 1.

Although in FIG. 1 the carburetor 40, passages 50, 50*a*, 50*b*, 52, 52*a*, 52*b*, 138, 140, 238, 240, etc., and ports 144, 146, 244, and 246, etc., are shown as developed in a plan view for the convenience of illustration, in the actual engine it is desirable that these means or structures should be three-dimensionally constructed in the following manner. In the first power cylinder - piston assembly 100, with respect to the passages 138 and 140, it is desirable that these passages open individually between a pair of crank arms 120 and 122 so that the flow of mixture introduced into the crankcase is not obstructed by the crank arm 120 or 122 and the piston 108 or 110. When the engine is in the cold state, liquid fuel accumulates in the bottom of the crankcase. Therefore, it is desirable that the passages 138 and 140 should open to the bottoms of the crankcases so that they can readily take out the accumulated fuel. It is also desirable that the ports 144 and 146 should open between the pair of crank arms 120 and 122 so that the flow of mixture is not obstructed by the arms 120 and 122. When the engine is in the cold state, the carburetor 40 provides poor atomization of fuel, and fuel droplets will be discharged into the passages 50, 52, 60, 62, 64. Therefore, it is desirable that the carburetor should be located above the pump or the crankcases of the power cylinder - piston assembly so that such fuel droplets can flow into the pump chamber or the crankcases by the action of gravity. Such an arrangement is shown in FIG. 2. Further, as seen in FIG. 1, it is desirable that the power assemblies 100 and 200 and the pump assembly 400 should be arranged as close to one another as possible. In this connection, therefore, it is desirable that the passages 152, 154, 74, 76, etc. should be arranged through the clearances left between the two power cylinder - piston assemblies and the power cylinder - piston assembly 200 and the pump cylinder - piston assembly 400. The ports through which the passages 152 and 154 open individually to the crankcases 124 and 126 may be located so as to oppose the crank arms 120, 122, or the pistons 108, 110, if the ports are adapted so as not to be strongly throttled, because the mixture supplied through the passages 152 and 154 is pressurized by the pump. These conditions are also applicable to the power cylinder - piston assembly 200.

The crankshafts 12 and 14 are drivingly connected with each other by way of sprocket wheels 16 and 18 individually mounted on them and an endless chain 20 engaged around the sprocket wheels, so that the crankshafts rotate in the same rotational direction at the same rotational speed. In this case, the phase relation between the two crankshafts is so determined that the crankpins 116 and 118, 216 and 218, and 444 and 446, individually related to the power pistons 108 and 110, 208 and 210, and 408 and 410, are shifted from each other by 180°. Further, in this case, the phase relation between the crankpin 116 related to the power piston 108 and the crankpin 216 related to the power piston 208, and the phase relation between the crankpin 118 related to the power piston 110 and the crankpin 218 related to the power piston 210, are individually shifted from each other by 180°. Still further, as apparent from the above described passage structure that the pump chamber 424 of the pump 400 is related to the first power cylinder - piston assembly 100 so as to supply scavenging mixture to this power assembly, while the pump chambers 426 and 428 are related to the second power cylinder - piston assembly 200 so as to supply scavenging mixture to this power assembly, the phase relation between the crankpin 116 related to the power piston 108 and the crankpin 444 related to the pump piston 408, and the phase relation between the crankpin 118 related to the power piston 110 and the crankpin 446 related to the pump piston 410, are individually shifted from each other by an angle of or around 180°. In this connection, it is desirable that the phase relation between the power pistons 108 and 110 and the pump pistons 408 and 410 should be so determined that, when the power pistons 108 and 110 are at their bottom dead center, the pump pistons 408 and 410 are at or around their top dead center with respect to the pump chamber 424, in accordance with the proposition made by the aforementioned co-pending patent application Ser. No. 917,244 now U.S. Pat. No. 4,287,859.

Figure 7:
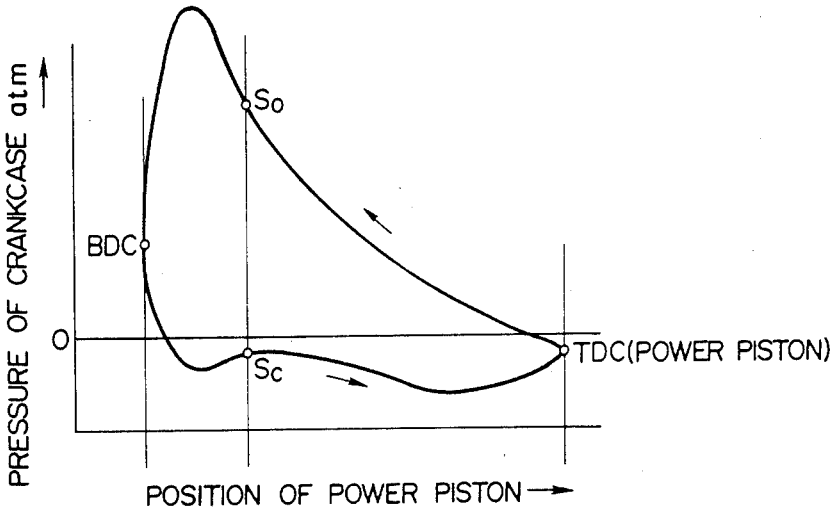
FIG. 7 is an indicator diagram showing the pressure in the crankcase of the engine shown in FIG. 5.

The scavenging pump means for the first and the second power cylinder - piston assemblies 100 and 200 are respectively composed of the series combination of the crankcases 124 and 126 and the pump chamber 424 of the pump 400, and the series combination of the crankcases 224 and 226 and the pump chambers 426 and 428 of the pump 400. Since the total stroke volume of the crankcases as a pump is equal to the total stroke volume of the corresponding power cylinder - piston assembly, when the total stroke volume of the scavenging pump means is determined to be 1.35–1.85 times as large as the total stroke volume of the power cylinder - piston assembly to which the scavenging pump means supplies scavenging mixture, in accordance with the proposition made by the aforementioned co-pending U.S. patent application Ser. No. 917,244 now U.S. Pat. No. 4,287,859, the total stroke volume of the pump 400 is 0.35–0.85 times as large as the total stroke volume of the corresponding power cylinder - piston assembly. In this case, therefore, the stroke volume of the pump chamber 424 is determined to be 0.35–0.85 times as large as the stroke volume of the power cylinder - piston assembly 100, while the sum of the stroke volumes of the pump chambers 426 and 428 is determined to be 0.35–0.85 times as large as the stroke volume of the power cylinder - piston assembly 200. The method of determining a particular value of the ratio of the stroke volume of the pump cylinder - piston assembly to that of the power cylinder - piston assembly within the aforementioned range is described in detail in the specification of the aforementioned co-pending patent application Ser. No. 917,244 now U.S. Pat. No. 4,287,859. In outline, first, the rotational speed of the engine which most frequently occurs when the engine is being operated in the full throttle condition is estimated, and based upon this rotational speed the stroke volume of the pump 400 is determined, so that, when scavenging mixture has just pushed exhaust gases out of the exhaust ports 130 or 230, the exhaust ports should be closed by the exhaust side piston 110 or 210. The mixture delivered from the pump 400 is introduced into the crankcases 124 and 126 or 224 and 226, which themselves perform pumping action, so that the pressure in the crankcases changes as shown in FIG. 7 in accordance with reciprocation of the power pistons 108 and 110, or 208 and 210, wherein the crankcase pressure is expressed by gauge pressure. The mixture compressed in the crankcases is discharged from the scavenging ports 128 or 228 into the power cylinder 102 or 202 at the pressure at the time point So (also see FIG. 6) where the scavenging ports are opened. The mixture is slightly throttled while it passes through the scavenging ports, and thereafter the mixture flows towards the exhaust ports 130 or 230 while forming a spiral flow, and expels exhaust gases through the exhaust ports. The time required for the scavenging mixture to reach the exhaust ports is determined by the pressure difference between the scavenging mixture and the combustion gases remaining in the power cylinder and the spiral distance between the scavenging ports and the exhaust ports travelled by the spiral flow of the mixture, while this time is not directly concerned with the rotational speed of the engine. Therefore, when the shape and the arrangement of the scavenging ports and the exhaust ports are determined, the abovementioned time is determined in accordance with the pressure at So of scavenging mixture, and its subsequent change. For a fixed performance of crankcase compression, the scavenging pressure at So is increased as the stroke volume of the pump 400 is increased. In this case, if the clearance volume of the crankcase is relatively large, the scavenging pressure at So is not much increased, while on the other hand the duration period of existence of relatively high scavenging pressure becomes longer. The volumetric efficiency of a reciprocating piston pump is higher as its reciprocating speed is lower, if the suction inertia effect of the pump is neglected. Therefore, if the engine is matched so that, at a certain rotational speed (this is called matching speed), just when scavenging mixture has pushed exhaust gases out of the exhaust ports, the exhaust ports should be closed, in operation at speeds below this matching speed the blow-out of mixture to the exhaust manifold will occur, while on the other hand in operation above the matching speed exhaust gases will remain in the power cylinder. Therefore, if the engine is to generate high torque in high speed rotation, the stroke volume of the pump 400 must be increased so as to increase the scavenging pressure. In this case, however, the blow-out of mixture to the exhaust manifold will increase in low speed full throttle operation. When the exhaust pipe has a substantial exhaust inertia effect, this also affects the time required for scavenging mixture to reach the exhaust ports. If the scavenging pressure is too high, it causes mixing of scavenging mixture and exhaust gases, so as to increase blow-out of mixture to the exhaust manifold, thereby lowering scavenging efficiency. In consideration of the abovementioned factors an estimation of pump stroke volume is made, and thereafter by the process of experiments the pump stroke volume must be modified so as to satisfy the requirements with regard to engine performance and to the standard for exhaust gas purification.

Now, if it is assumed that the power cylinder - piston assemblies 100 and 200 have the same diameter Dw and the same piston stroke Lw (which equals twice the crank radius of the crank pins 116, 118, 216 and 218) with respect to their power cylinders, and that the pump cylinder - piston assembly 400 has diameter Dp and piston stroke Lp (which equals twice the crank radius of the crank pins 444 and 446) with respect to its pump cylinder, wherein the pump piston stroke is reduced as compared with the power piston stroke so that Lp equals Lw/A (A is larger than 1), the diameter Dp of the pump cylinder 406 is in the range (0.35 to 0.85) A×Dw Therefore, if A is about 2, as in the embodiment shown in FIGS. 1–5, Dp is in the range (0.84 to 1.3) Dw If A is somewhat smaller, such as to be 1.75, Dp is in the range (0.78 to 1.22) Dw By contrast, if A is somewhat larger, such as to be 2.25, Dp is in the range (0.89 to 1.38) Dw As is understood from FIG. 4, if the value of A is around 2, the oscillating angle of the connecting rod 438 is reduced to a small angle that sufficiently reduces the side force applied to the cross head 430 so that smooth reciprocation of the cross head is ensured.

The operation of the two-stroke cycle gasoline engine shown in FIGS. 1–5 will be described hereinunder. In this connection, in the following the description is made with respect only to the power cylinder - piston assembly 100 and the related pump chamber 424 of the pump cylinder - piston assembly 400. However, it will be understood that the operation of the power cylinder - piston assembly 200 and the related pump chambers 426 and 428 of the pump cylinder - piston assembly 400 is substantially the same as that of the combination of the power cylinder - piston assembly 100 and the pump chamber 424. When the power pistons 108 and 110 individually move from their BDC towards their TDC, the pump pistons 408 and 410 individually move from their TDC with respect to the pump chamber 424 (where the pump pistons most approach the axial midpoint of the pump cylinder 402) toward their BDC (where the pump pistons depart most from each other). When the pressure difference across the reed valve 66 overcomes the spring force of the reed valve, the pump chamber 424 begins to draw in mixture through the reed valve. Similarly, when the pressure difference across the reed valves 148 and 150 overcomes the spring force of the reed valves, the crankcases 124 and 126 begin to draw in mixture. Thereafter, when the power pistons 108 and 110 individually move from their TDC towards their BDC, the pump pistons 408 and 410 individually move from their BDC towards their TDC with respect to the pump chamber 424, whereby the pressure in the crankcases 124 and 126 and the pressure in the pump chamber 424 increase. In this connection, it is to be noted that, even when the pump pistons 408 and 410 have passed their BDC with respect to the pump chamber 424, the reed valves 66, 148, and 150 are still open for a while, due to the suction inertia effect, so that suction of mixture is continued during such a period. As the compression by the pump chamber 424 proceeds, since the compression ratio of the pump chamber is higher than that of the crankcases 124 and 126, the mixture compressed by the pump chamber 424 soon pushes open the reed valve 160 so as to flow into the crankcases 124 and 126. As the power pistons 108 and 110 approach their BDC, first the exhaust ports 130 open (FIG. 6), whereby the exhaust gases existing in the power cylinder 102 are discharged through the exhaust ports into the exhaust plenum 134, wherefrom they are exhausted through the exhaust pipes 136, and the pressure of the residual exhaust gases existing in the power cylinder 102 rapidly lowers. Then, as the power pistons further proceed toward their BDC, the scavenging ports 128 are opened, whereby compressed mixture is discharged through the scavenging ports into the power cylinder 102, and flows towards the exhaust ports 130 in the form of a spiral flow while pushing the residual exhaust gases existing in the power cylinder out of the exhaust ports. The scavenging pressure lowers substantially proportionally to the crankcase pressure shown in FIG. 7. After the power pistons 108 and 110 have passed their BDC, the flow of scavenging mixture into the power cylinder 102 continues for a while due to the inertia effect, although the amount of flow of mixture by this effect is very small. As the power pistons 108 and 110 move towards their TDC, first the scavenging ports 128 are closed by the power piston 108 on the scavenging side, and then the exhaust ports 130 are closed by the power piston 110 on the exhaust side. After this, the compression of the mixture is initiated. Some time before the power pistons reach their TDC, the compressed mixture is ignited by the ignition plug 156, and the mixture is combusted. After the power pistons have passed their TDC, combustion and expansion stroke is performed and power is produced. Then the exhaust ports 130 are again opened so that the engine completes an operational cycle. The reed valves 66, 148, and 150 are indispensable for the pump chamber 424 and the crankcases 124 and 126 to perform compression stroke, while on the other hand the reed valve 160 is not necessarily indispensable. Without this, however, since the pump chamber 424 enters into suction stroke after the power pistons 108 and 110 have passed their BDC, the pressure in the crankcases 124 and 126 will undesirably lower. It is desirable that the reed valves 148 and 150 should be positioned so as to be close to the wall of the crankcases so that the clearance volumes of the crankcases are reduced.

In this connection, it is noted in FIG. 7 that the pressure in the crankcases abruptly lowers after the power pistons have reached their BDC. In view of this, it is contemplated to retard further the phase of the pump pistons with respect to that of the power pistons by an angle of up to about 15° in addition to the phase difference of 180° therebetween, so that the operational phase angle of the pump pistons is delayed relative to that of the power pistons by an angle of 180°–195°, whereby the scavenging in the latter half of the scavenging period, i.e. after the power pistons have passed their BDC, can be somewhat improved.

Figure 8:
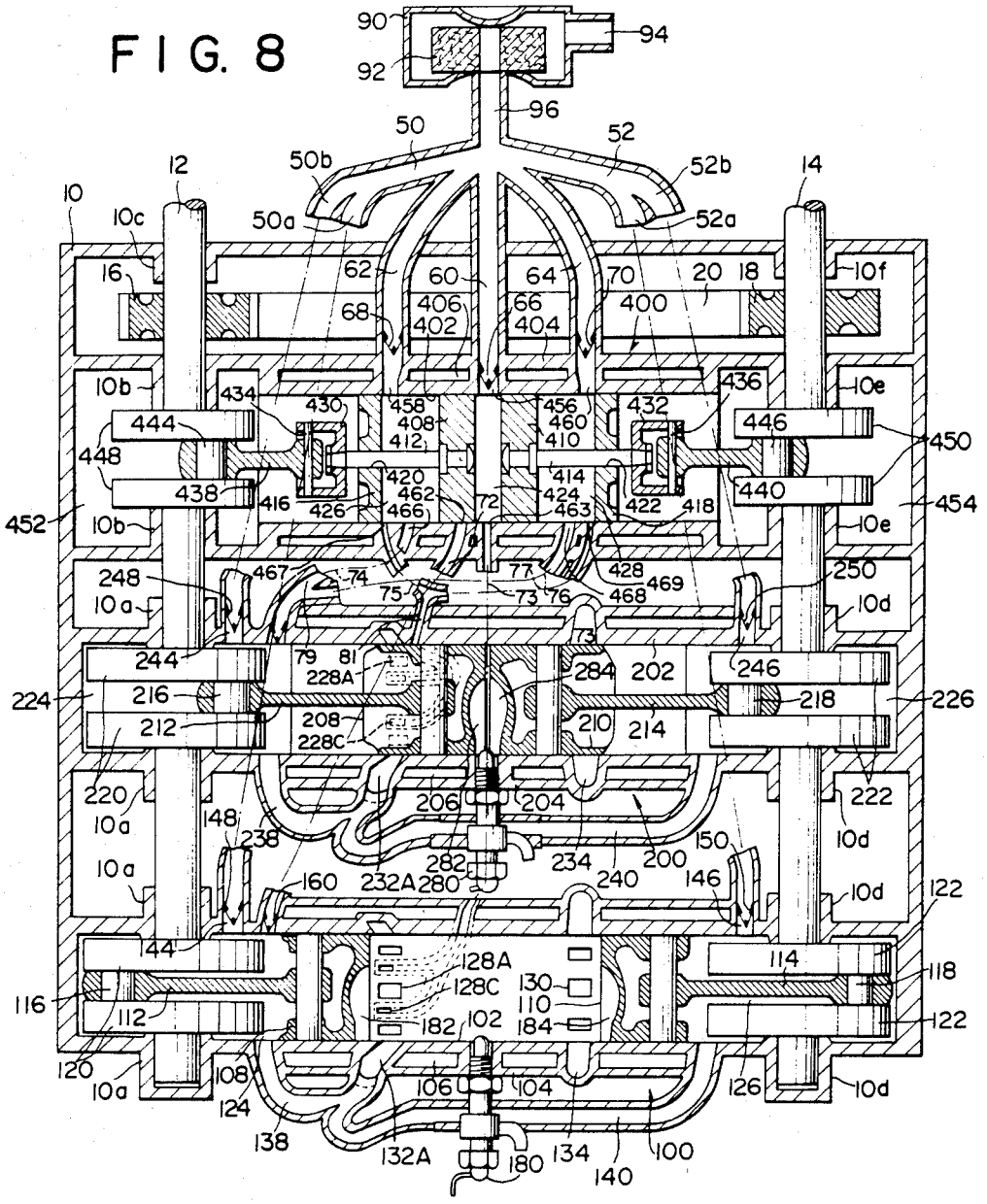
FIG. 8 is a diagrammatical plan sectional view showing an embodiment of a two-stroke cycle diesel engine in which the present invention is incorporated.

FIG. 8 is a diagrammatical plan sectional view showing an embodiment of a two-stroke cycle diesel engine in which the present invention is incorporated. The basic structure of this diesel engine is shown in co-pending U.S. patent application Ser. No. 966,597, filed on Dec. 5, 1978 now U.S. Pat. No. 4,248,183, under the title of "A Two-Stroke Cycle Diesel Engine", based upon an invention made by the same inventors as the present application, in particular in FIGS. 20 and 21 of the drawing filed with the application. In FIG. 8, the portions corresponding to those shown in FIG. 20 of the aforementioned former application are designated by the same reference numerals as in that figure. In the diesel engine shown in FIG. 8, its general constitution, including a cylinder block 10, a pair of crankshafts 12 and 14, bearings 10*a*–10*f* which support the crankshafts, first and second power cylinder - piston assemblies 100 and 200, and a double acting pump cylinder - piston assembly 400, is substantially the same as the general constitution of the two-stroke cycle gasoline engine shown in FIG. 1. In this diesel engine, the power cylinder - piston assembly 100 includes a power cylinder 102 surrounded by a cooling jacket 106 defined by a jacket wall 104 and two opposedly arranged power pistons 108 and 110, which are respectively connected with connecting rods 112 and 114, which in turn are respectively connected with crankpins 116 and 118, which are individually supported by crank arms 120 and 122, which are individually incorporated in the crankshafts 12 and 14. The crank arms 120 and 122 have individually a disk shape and are housed in crankcases 124 and 126 having a corresponding internal shape so that regardless of rotational angle of the crank the principal internal space of each crankcase is occupied by the crank so as to reduce the clearance volume of the crankcase to the minimum value.

The cylinder 102 has a plurality of scavenging ports 128A adapted to be supplied with scavenging air from the crankcases 124 and 126 through passages 138 and 140 and a scavenging plenum 132A, and a plurality of scavenging ports 128C adapted to be supplied with scavenging air directly from the pump 400. 180 is a fuel injection nozzle. In relation to this, cavities 182 and 184 are provided in the power pistons 108 and 110, respectively, so as to avoid close interference between fuel spray ejected from the fuel injection nozzle and the piston heads.

The second power cylinder - piston assembly 200 has substantially the same structure as the first power cylinder - piston assembly 100. In FIG. 8, therefore, the portions of the second power cylinder - piston assembly 200 corresponding to those in the first power cylinder - piston assembly 100 are designated by reference numerals which are the reference numerals attached to the corresponding portions of the first cylinder - piston assembly 100, each increased by 100. Further, as apparent from FIG. 8, the power pistons 108 and 110 of the first power cylinder - piston assembly 100 and the power pistons 208 and 210 of the second power cylinder - piston assembly 200 are shifted apart by a phase difference of 180°.

The double acting pump cylinder - piston assembly 400 has a pump cylinder 402 supported by the cylinder block 10 and surrounded by a cooling jacket 406 defined by a jacket wall 404. In the pump cylinder 402 are opposedly provided a pair of disk-like pump pistons 408 and 410, which are individually connected with push rods 412 and 414, which individually extend through openings 420 and 422 formed in end plates 416 and 418, which close opposite ends of the pump cylinder 402. The openings 420 and 422 are individually constructed as bearing openings which slidably and sealingly receive the push rods 412 and 414, respectively. By this arrangement the inside of the pump cylinder 402 is divided into three pump chambers 424, 426, and 428. The other ends of the push rods 412 and 414 are individually connected with cross heads 430 and 432, which are axially slidably received in opposite end portions of the pump cylinder 402. The cross heads 430 and 432 are individually connected with the smaller ends of connecting rods 438 and 440 by pins 434 and 436, respectively. The larger end portions of the connecting rods 438 and 440 are individually engaged with crank pins 444 and 446, which are individually supported by pairs of crank arms 448 and 450, which are individually housed in crankcases 452 and 454.

90 designates an air cleaner which includes an air cleaner element 92 and takes in air from its air inlet port 94 and delivers clean air through its air outlet port 96. The air outlet port 96 is connected with ports 144 and 244 of the first and second power cylinder - piston assemblies 100 and 200, which individually open to the crankcases 124 and 224 of the first and second power cylinder - piston assemblies, by a common passage 50 and two branch passages 50*a* and 50*b*, respectively. Similarly, the outlet port 96 of the air cleaner 90 is connected with ports 146 and 246 of the first and second power cylinder - piston assemblies 100 and 200, which individually open to the crankcases 126 and 226 of the first and second power cylinder - piston assemblies, by a common passage 52 and two branch passages 52*a* and 52*b*. Further, the outlet port 96 of the air cleaner 90 is connected with ports 456, 458, and 460, which open to the pump chambers 424, 426, and 428, by way of passages 60, 62, and 64, respectively. The pump cylinder 402 has air outlet ports 462 and 463 provided for the pump chamber 424, air outlet ports 466 and 467 provided for the pump chamber 426, and air outlet ports 468 and 469 provided for the pump chamber 428. In this case, the air outlet port 462 is closed in advance of the air outlet port 463 when the pump pistons 408 and 410 approach toward their TDC with respect to the pump chamber 424. Similarly, the air outlet ports 466 and 468 are closed in advance of the air outlet ports 467 and 469, respectively, when the pump pistons approach to their TDC with respect to the pump chambers 426 and 428. The air compressed in the pump chamber 424 is supplied to both the crankcase 124 and the scavenging ports 128C of the first power cylinder - piston assembly 100 through the air outlet ports 462 and 463 and passages 72 and 73, respectively, in an early stage of scavenging, and then is supplied only to the scavenging ports 128C in a later stage of scavenging after the air outlet port 462 has been closed by the pump piston 408. Similarly, the air compressed in the pump chambers 426 and 428 is supplied to both the crankcase 224 and the scavenging ports 228C through the air outlet ports 466, 468, 467, and 469, and passages 74, 75, 76, 77, 79, and 81, respectively, in an early stage of scavenging, and then is supplied only to the scavenging ports 228C in a later stage of scavenging after the air outlet ports 466 and 468 have been closed by the pump piston 408 and 410. This staged port structure operates so as to perform a first stage of scavenging with a relatively weak swirl of scavenging air in the power cylinder and a second stage of scavenging with a relatively strong swirl of scavenging air in the power cylinder, thereby substantially increasing volumetric efficiency of scavenging and also improving combustion of fuel.

In the diesel engine proposed in the aforementioned co-pending patent application Ser. No. 966,597 now U.S. Pat. No. 4,248,183, it has been proposed that, when the engine incorporates crankcase compression as in the embodiment shown in FIG. 8 of the present application, the total stroke volume of the scavenging pump device which includes the pump cylinder - piston assembly 400 is 1.5–2.2 times as large as the total stroke volume of the power cylinder - piston assemblies. In this case, if it is assumed that the power cylinder - piston assemblies 100 and 200 have the same diameter Dw and the same piston stroke Lw (which is equal to twice the crank radius of the crankpins 116, 118, 216, and 218) with respect to their power cylinders, and that the pump cylinder - piston assembly 400 has the cylinder diameter Dp and the piston stroke Lp (which is equal to twice the crank radius of the crankpins 444 and 446), wherein Lp is reduced as compared with the piston stroke of the pump cylinder - piston assemblies so as to be equal to Lw/A (A is larger than 1), the diameter Dp of the pump cylinder 402 comes to be in the range (0.5 to 1.2) A×Dw If A is 2, Dp is in the range (1.00 to 1.55) Dw If A is somewhat smaller, so as to be, for example, 1.75, Dp is in the range (0.94 to 1.45) Dw If A is somewhat larger, so as to be, for example, 2.25, Dp is in the range (1.06 to 1.64) Dw Although the invention has been shown and described with rspect to some preferred embodiments thereof, it should be understood by those skilled in the art that various changes and omissions of the form and the detail thereof may be made therein without departing from the scope of the invention.

We claim:

1. A two-stroke cycle engine comprising: at least two two-stroke cycle power cylinder - piston assemblies each having a power cylinder provided with scavenging ports located near one axial end thereof and exhaust ports located near the other axial end thereof so as to perform uniflow scavenging, two horizontally opposed pistons disposed in said power cylinder and two crankcases which perform crankcase compression of scavenging charge and have the same total stroke volume as that of the power cylinder - piston assembly, said two power cylinder - piston assemblies operating with a phase difference of 180° relative to each other, said scavenging ports being arranged substantially symmetrically around the central axis of each of said power cylinders so as to generate a spiral flow of scavenging charge through said power cylinder; at least one double acting pump cylinder - piston assembly which has a pump cylinder and two horizontally opposed pistons disposed in said pump cylinder and is driven by said power cylinder - piston assemblies so as to supply two separate scavenging charges to said two power cylinder - piston assemblies with a phase difference of 180° therebetween; and a pair of common crankshafts adapted to rotate in synchronization with each other, each of said power cylinder - piston assemblies and said pump cylinder - piston assembly having a pair of crank mechanisms which incorporate said pair of common crankshafts so as to operate in synchronization with each other, wherein the sum of the total stroke volume of said pump cylinder - piston assembly and that of said crankcases is larger than the total stroke volume of said power cylinder - piston assemblies, and wherein the crank radius of each of said pair of common crankshafts with respect to said pump cylinder - piston assembly is substantially smaller than that with respect to said power cylinder - piston assemblies.

2. The engine of claim 1, wherein said engine is a gasoline engine which has two said power cylinder - piston assemblies relative to one said pump cylinder - piston assembly, and wherein the total stroke volume of said pump cylinder - piston assembly is 0.35–0.85 times as large as that of said power cylinder - piston assemblies.

3. The engine of claim 1, wherein said engine is a diesel engine which has two said power cylinder - piston assemblies relative to one said pump cylinder - piston assembly, and wherein the total stroke volume of said pump cylinder - piston assembly is 0.5–1.2 times as large as that of said power cylinder - piston assemblies.

4. The engine of claim 1, wherein said pump cylinder and said power cylinders conform to the relationship:

$$D_1=(X)D_2$$

where $D_1$ is the diameter of said pump cylinder, $D_2$ is the diameter of said power cylinders, $$X=\left(\sqrt{\frac{S_1}{S_2}}\right)(\sqrt{A})$$

$S_1$ is the stroke volume of said pump cylinder, $S_2$ is the total stroke volume of said power cylinders, $$\frac{1}{A}=\frac{CR_1}{CR_2},$$

$CR_1$ is the crank radius of said pump cylinder, and $CR_2$ is the crank radius of said power cylinders.

* * * * *